United States Patent [19]

Nanda

[11] 4,407,122

[45] Oct. 4, 1983

[54] POWER TRANSMISSION

[75] Inventor: Vinod K. Nanda, Rochester, Mich.

[73] Assignee: Vickers, Incorporated, Troy, Mich.

[21] Appl. No.: 264,342

[22] Filed: May 18, 1981

[51] Int. Cl.[3] ..... F15B 7/04

[52] U.S. Cl. ..... 60/452; 91/433; 91/455; 91/461

[58] Field of Search ..... 91/455, 461, 433, 454; 137/85, 625.62; 60/452

[56] References Cited

U.S. PATENT DOCUMENTS

| | | | |
|---|---|---|---|
| 2,931,389 | 4/1960 | Moog | 137/625.62 |
| 3,015,317 | 1/1962 | Buchanan | 137/625.62 |
| 3,807,447 | 4/1974 | Masuda | 91/433 X |
| 3,859,791 | 1/1975 | Allen | 91/433 X |
| 4,201,052 | 5/1980 | Breeden | 91/454 X |
| 4,250,794 | 2/1981 | Haak | 91/454 X |

*Primary Examiner*—Robert G. Nilson

*Attorney, Agent, or Firm*—Barnes, Kisselle, Raisch, Choate, Whittemore & Hulbert

[57] ABSTRACT

A hydraulic control system comprising a hydraulic actuator having opposed openings adapted to alternately function as inlets and outlets for moving the element of the actuator in opposite directions, a pump for supplying fluid to said actuator, pilot operated meter-in valve means to which the fluid from the pump is supplied for controlling the direction of movement of the actuator, pilot operated meter-out valve means associated with each opening of the actuator for controlling the flow out of said actuator. The pressure of fluid being supplied to the actuator by the meter-in valve means is sensed and caused to produce a force opposing the movement of the meter-in valve means by the pilot pressure resulting in a smooth and accurate control of the movement of the actuator.

5 Claims, 5 Drawing Figures

POWER TRANSMISSION

This invention relates to power transmissions and particularly to hydraulic circuits for actuators such as are found on earth moving equipment including excavators.

BACKGROUND AND SUMMARY OF THE INVENTION

This invention relates to hydraulic systems for controlling a plurality of actuators such as hydraulic cylinders which are found, for example, in earth moving equipment such as excavators and cranes. In such a system, it is conventional to provide a pilot operated control valve for each actuator which is controlled by a manually operated controller through a pilot hydraulic circuit. The control valve functions to supply hydraulic fluid to the actuator to control the speed and direction of operation of the actuator. In addition, the control valve for each actuator controls the flow of hydraulic fluid out of the actuator. It is also common to provide counterbalance valves or fixed restrictions to control overrunning loads.

In U.S. Pat. No. 4,201,052 and U.S. application of Kurt R. Lonnemo, Ser. No. 117,936, filed Feb. 4, 1980, having a common assignee with the present application, there is disclosed and claimed a hydraulic system for accurately controlling the position and speed of operation of the actuators; which system is simple and easy to make and maintain; which system is unaffected by change of load pressure of various portions of the system or other actuators served by the same source; which system may not use flow from the pressure source in the case of overrunning loads on the actuators; wherein the control valves may be mounted adjacent the actuator for preventing loss of control of the load in case of malfunction in the hydraulic lines to the actuator; wherein the valves which control flow out of the actuator function to control the velocity in the case of energy generating loads; wherein the valve that controls flow into the actuator controls the velocity in the case of energy absorbing loads; wherein the valve system for each actuator can be mounted on its respective actuator and incorporates means for preventing uncontrolled lowering of the load in case of pressure failure due to breaking of the lines to the actuator mounted valve system; wherein the timing of operation of the valve controlling flow into the actuator and out of the actuator can be designed to accommodate the specific nature of the particular load. In certain high inertial loads such as swing drives on an excavator which utilize rotary actuators, smooth stopping and starting of the load and accurate positioning of the load are very essential.

Accordingly, the present invention is directed to a hydraulic system providing for smooth stepping and starting and accurate loading under high inertial loads.

The hydraulic control system comprises a hydraulic actuator, a pilot controller and a pump. The actuator includes a movable element and a pair of openings adapted to function alternately as inlets or outlets for moving the element in opposite directions. The pilot controller supplies fluid to the system at pilot pressure and the pump supplies fluid at pump pressure to the actuator. The control system includes a line adapted for connection to each of the openings and a meter-out valve associated with each of the lines for controlling fluid flow from the actuator. The meter-out valves are each selectively pilot operated by pilot pressure from the pilot controller. A meter-in valve means controls fluid flow from the pump to the actuator and is selectively operable by pilot pressure from the pilot controller. In accordance with the invention, the supply pressure out of the meter-in valve means is sensed and a pressure is applied to the meter-in valve means opposing the pilot pressure which tends to open the meter-in valve means.

DESCRIPTION OF THE DRAWINGS

Referring to FIG. 1, the hydraulic system embodying the invention comprises an actuator 20, herein shown as a rotary hydraulic cylinder, having an output shaft 21 that is moved in opposite directions by hydraulic fluid supplied from a variable displacement pump system 22 which has load sensing control in accordance with conventional construction. The hydraulic system further includes a manually operated controller, not shown, that directs a pilot pressure to a valve system 24 for controlling the direction of movement of the actuator, as presently described. Fluid from the pump 22 is directed to the line 25 and line 26 to a meter-in valve 27 that functions to direct and control the flow of hydraulic fluid to one or the other end of the actuator 20. The meter-in valve 27 is pilot pressure controlled by controller, not shown, through lines 28,29 and lines 30,31 to the opposed ends thereof, as presently described. Depending upon the direction of movement of the valve, hydraulic fluid passes through lines 32,33 to one or the other end of the actuator 20.

Figure 1:
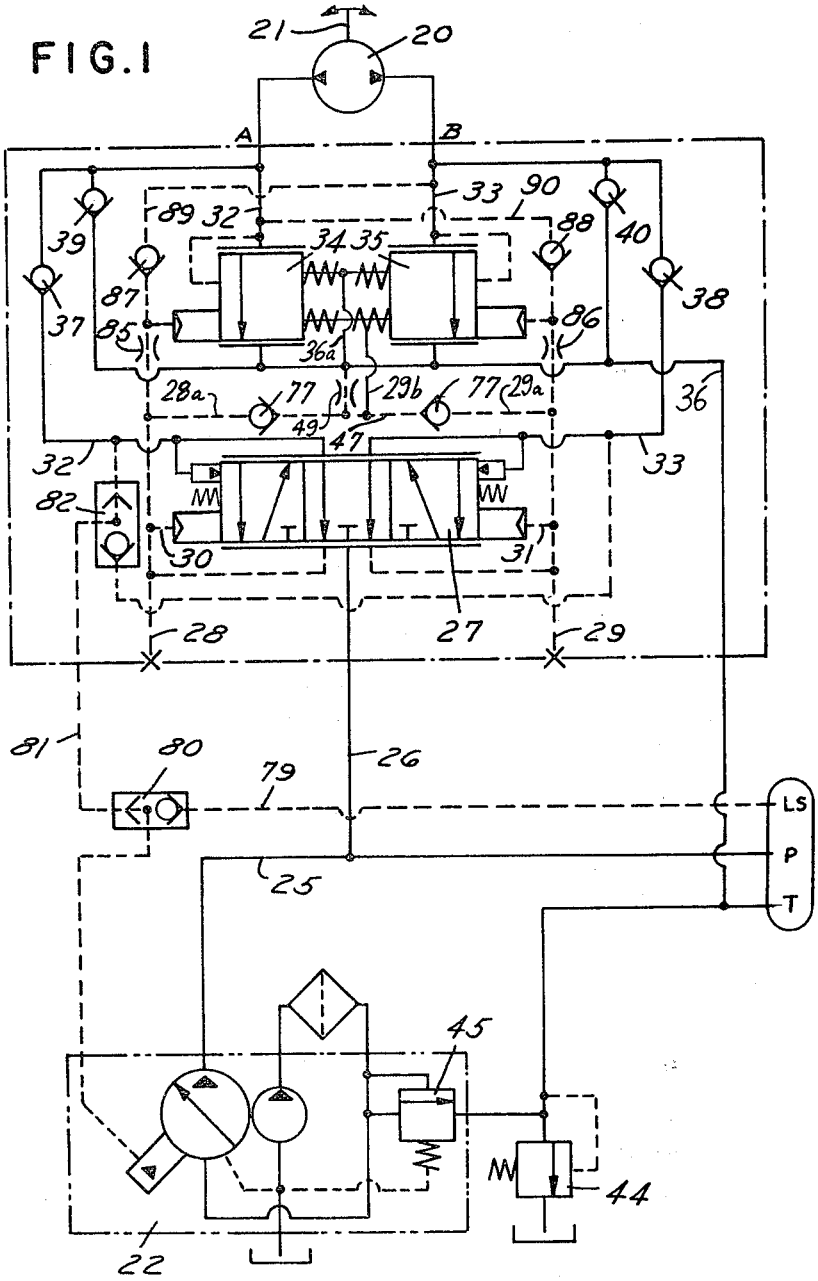
FIG. 1 is a schematic drawing of the hydraulic circuit embodying the invention.

The hydraulic system further includes a meter-out valve 34,35 associated with each end of the actuator in lines 32,33 for controlling the flow of fluid from the end of the actuator to which hydraulic fluid is not flowing from the pump to a tank passage 36, as presently described.

The hydraulic system further includes spring loaded poppet valves 37,38 in the lines 32,33 and spring-loaded anti-cavitation valves 39,40 which are adapted to open the lines 32,33 to the tank passage 36. In addition, spring-loaded poppet valves, not shown, are associated with each meter-out valve 34,35 acting as pilot operated relief valves. A bleed line 47 having an orifice 49 extends from passage 36 to meter-out valves 34,35 and to the pilot control lines 28,29 through check valves 77 in branch lines *28a,29a*. The spring ends of meter-out valves 34,35 are connected to lines **36,29*a* by lines *36a,29b***, respectively.

The system also includes a back pressure valve 44 associated with the return or tank line. Back pressure valve 44 functions to minimize cavitation when an overrunning or a lowering load tends to drive the actuator down. A charge pump relief valve 45 is provided to take excess flow above the inlet requirements of the pump 22 and apply it to the back pressure valve 44 to augment the fluid available to the actuator.

Meter-in valve 27 comprises a bore in which a spool is positioned and the absence of pilot pressure maintained in a neutral position by springs. The spool normally blocks the flow from the pressure passage 26 to the passages 32,33. When pilot pressure is applied to either passage 30 or 31, the meter-in spool is moved in the direction of the pressure until a force balance exists among the pilot pressure, the spring load and the flow forces. The direction of movement determines which of the passages 32,33 is provided with fluid under pressure from passage 26.

When pilot pressure is applied to either line 28 or 29, leading to meter-out valves 34 or 35, the valve is actuated to throttle flow from the associated end of actuator 20 to tank passage 36.

It can thus be seen that the same pilot pressure which functions to determine the direction of opening of the meter-in valve also functions to determine and control the opening of the appropriate meter-out valve so that the fluid in the actuator can return to the tank line.

In the case of an energy absorbing load, when the controller is moved to operate the actuator 20 in a predetermined direction, pilot pressure applied through line 28 and passage 30 moves the spool of the meter-in valve to the right causing hydraulic fluid under pressure to flow through passage 33 opening valve 38 and continuing to the inlet B of actuator 20. This same pilot pressure is applied to the meter-out valve 34 permitting the flow of fluid out of the end of the actuator 20 to the return or tank passage 36.

When the controller is moved to operate the actuator, for example, for an overrunning or lowering a load, the controller is moved so that pilot pressure is applied to the line 28. The meter-out valve 34 opens before the meter-in valve 27 under the influence of pilot pressure. The load on the actuator forces hydraulic fluid through the opening A of the actuator past the meter-out valve 34 to the return or tank passage 36. At the same time, the valve 40 is opened permitting return of some of the fluid to the other end of the actuator through opening B thereby avoiding cavitation. Thus, the fluid is supplied to the other end of the actuator without opening the meter-in valve 27 and without utilizing fluid from the pump.

To achieve a float position, the controller is bypassed and pilot pressure is applied to both pilot pressure lines 28,29. This is achieved, for example, by a circuit, not shown, which will apply the fluid from a pilot pump directly to lines 28,29 causing both meter-out valves 34 and 35 to open and thereby permit both ends of the actuator to be connected to tank pressure. In this situation, the meter-out valves function in a manner permitting fluid to flow back and forth between opposed ends of the cylinder.

By varying the spring forces and the areas on the meter-in valve 27 and the meter-out valves 34,35, the timing between these valves can be controlled. Thus, for example, if the timing is adjusted so that the meter-out valve leads the meter-in valve, the meter-in valve will control flow and speed in the case where the actuator is being driven. In such an arrangement with an overhauling load, the load-generated pressure will result in the meter-out valve controlling flow and speed. In such a situation, the anti-cavitation check valves 39,40 will permit fluid to flow to the supply side of the actuator so that no pump flow is needed to fill the actuator in an overhauling load mode or condition.

A check valve 77 is provided in a branch of each pilot line 28,29 adjacent each meter-out valve 34,35. The valves 77 allow fluid to bleed from the high tank pressure in passage 36, which fluid is relatively warm, and to circulate through pilot lines 28,29 back to the controller and the fluid reservoir when no pilot pressure is applied to the pilot lines 28,29. When pilot pressure is applied to a pilot line, the respective check valve 77 closes isolating the pilot pressure from the tank pressure.

Provision is made for sensing the maximum load pressure in one of a multiple of valve systems 24 controlling a plurality of actuators and applying that higher pressure to the load sensitive variable displacement pump 22. Each valve system 24 includes a line 81 extending to a shuttle valve 80 that receives load pressure from an adjacent actuator through line 79. Shuttle valve 80 senses which of the pressures is greater and shifts to apply the higher pressure to pump 22. A line 84 extends from passage 32 to shuttle valve 82. Shuttle valve 82 senses which of the pressures is greater and shifts to apply the higher pressure to pump 22. Thus, each valve system in succession incorporates shuttle valves 80,82 which compare the load pressure therein with the load pressure of an adjacent valve system and transmit the higher pressure to the adjacent valve system in succession and finally apply the highest load pressure to pump 22.

The above described circuit is shown and described in the aforementioned U.S. Pat. No. 4,201,052 and pending application Ser. No. 117,936. The single meter-in valve 27 may be replaced by two meter-in valves as described in the aforementioned application Ser. No. 117,936.

The details of the preferred construction of the elements of the hydraulic circuit are more specifically described in the aforementioned U.S. Pat. No. 4,201,052 and application Ser. No. 117,936 which are incorporated herein by reference.

Figure 3:
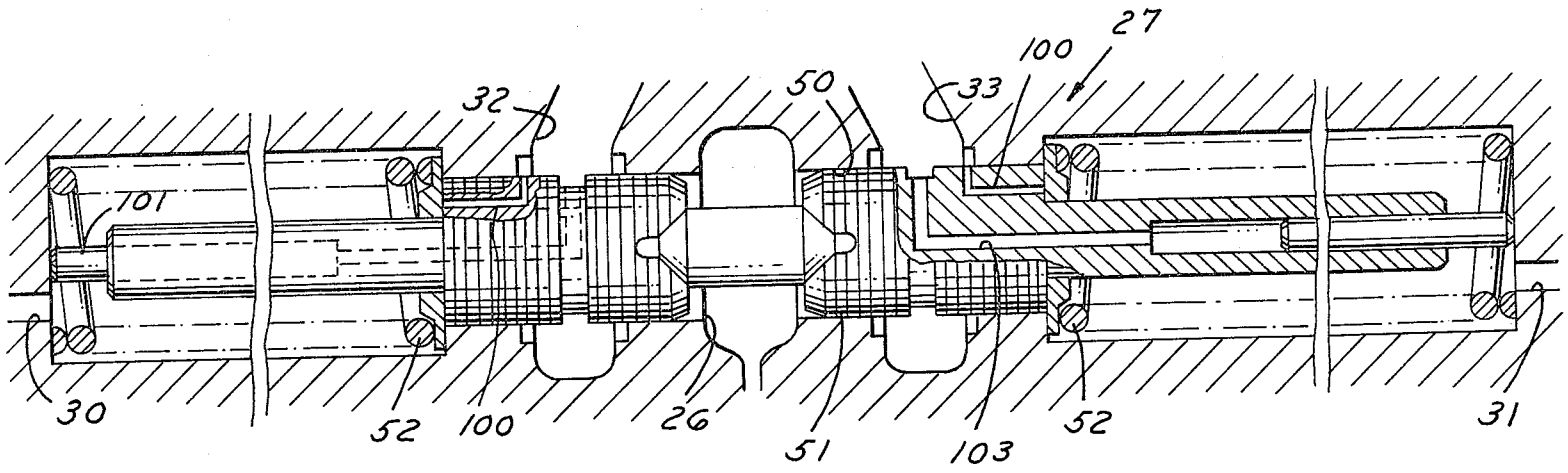
FIG. 3 is a fragmentary sectional view of a meter in valve utilized in the system.
Figure 4:
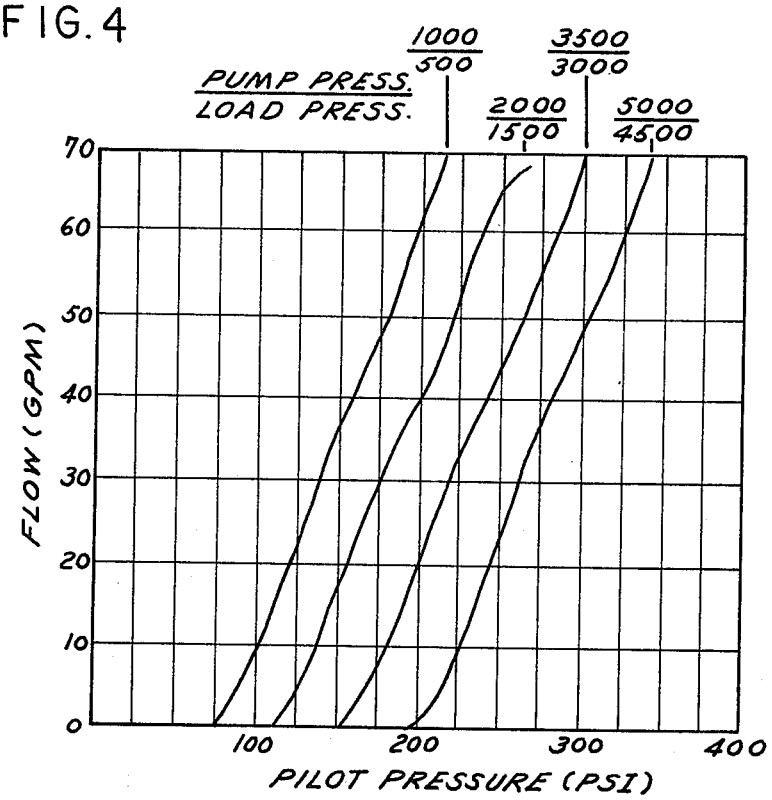
FIG. 4 are curves of flow versus pilot pressure.

Referring to FIG. 3, the meter-in valve 27 comprises a bore 50 in which a spool 51 is positioned and in the absence of pilot pressure maintained in a neutral position by springs 52. The spool 51 normally blocks the flow from the pressure passage 26 to the passages 32,33. When pilot pressure is applied to either passage 30 or 31, the meter-in spool 51 is moved in the direction of the pressure until a force balance exists among the pilot pressure, the spring load and the flow forces. The direction of movement determines which of the passages 32,33 is provided with fluid under pressure from passage 26.

In accordance with the invention, the meter-in valve 27 is modified from that shown in U.S. Pat. No. 4,201,052 so that it includes only a load sensing bleed orifice 100 and no check valve since the amount of flow through the orifice due to pilot pressure is insignificant. In addition, a load piston 101 is provided in the hollow end of the spool and abuts the chamber 102 in which the spring 52 is positioned. The load or outlet pressure is also applied to the end of the load piston 101 through a passage 103 so that a pressure proportional to outlet pressure acts on an area equivalent to the area of the piston 101 opposing the force tending to open the spool.

Figure 2:
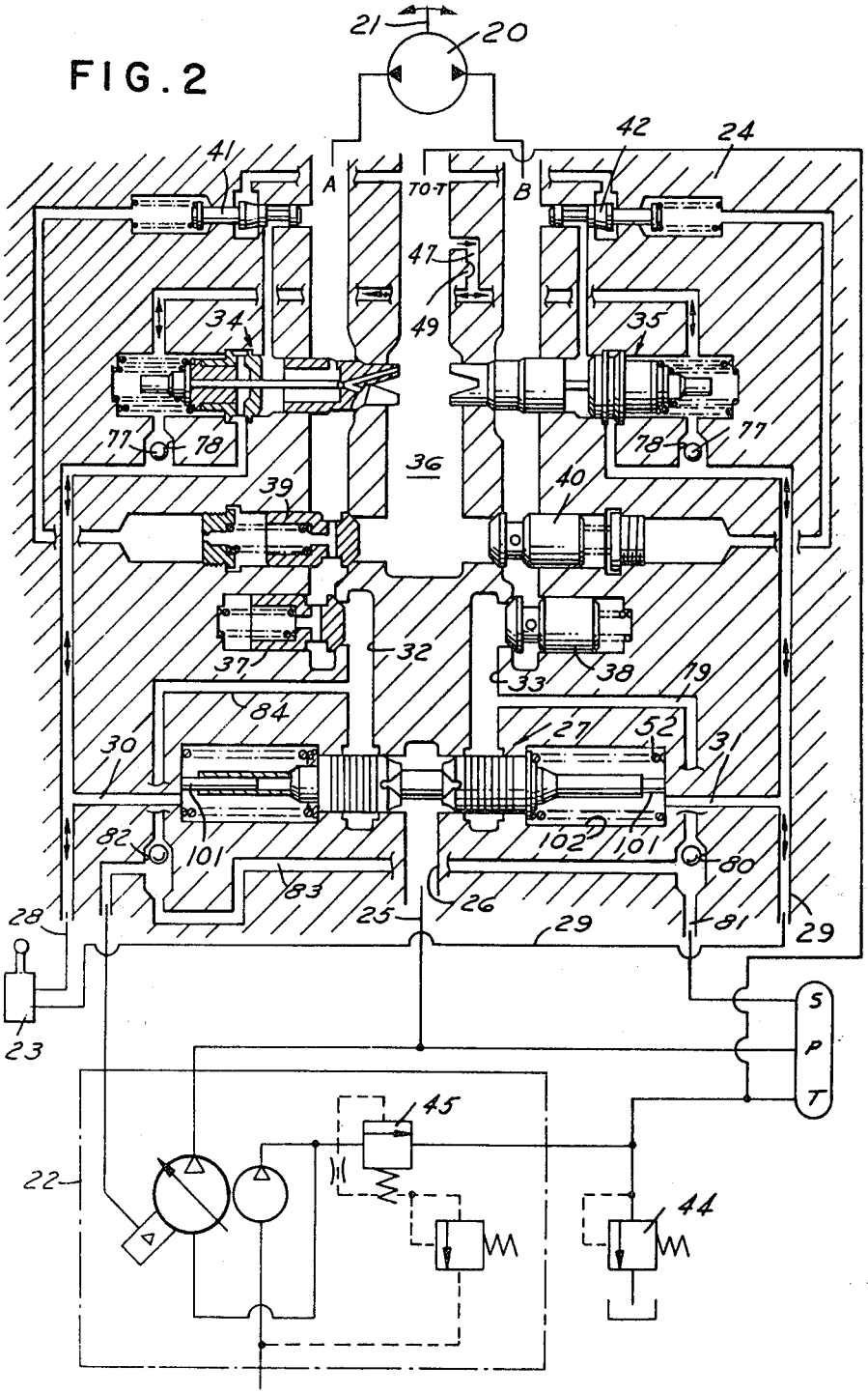
FIG. 2 is a partly diagrammatic view of a hydraulic circuit embodying the invention.

For example, referring to FIGS. 1 and 2, if pilot pressure is applied tending to shift the meter-in spool to the left in order to supply pressure to the A part of rotary actuator, outlet pressure acts through passage 103 on the area of the piston 101 at the opposite end of the meter-in valve opposing the force tending to open the spool.

Test results have shown that the curves of flow versus pilot pressure are such that a gradual change in speed of the load is possible.

Figure 5:
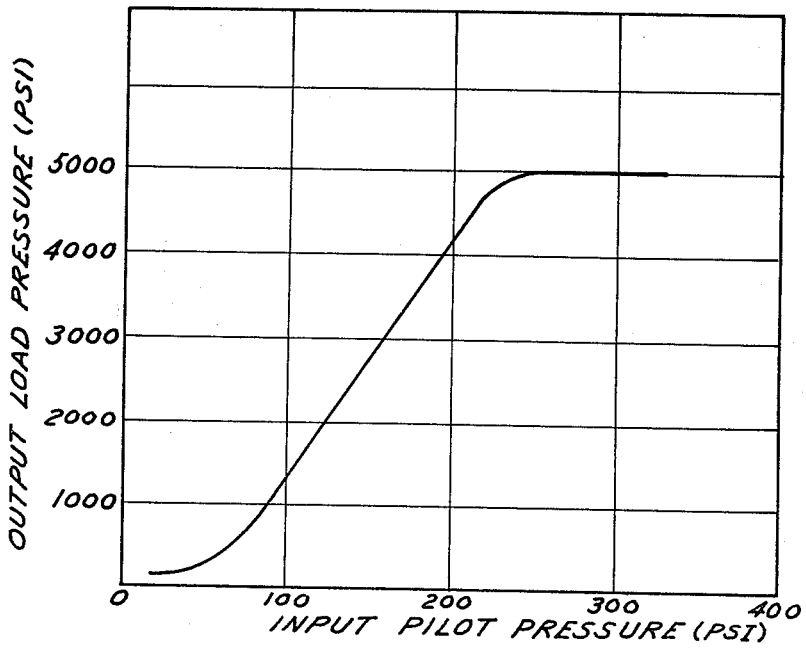
FIG. 5 is a curve of output load pressure versus input pilot pressure.

Referring to FIG. 5, test results have shown that for a stalled motor condition, or zero load flow, the system operates to produce an output pressure at the load corresponding to an input pilot pressure. As a result, the system makes it possible to start and stop a load in small increments, that is, move the load in small increments.

Without the feedback piston 101, the flow to the actuator is independent of the load pressure. Thus, a step input of flow to a stationary load could result in high pressure peaks and resulting high acceleration. As the load starts to move, pressure could drop and result in low acceleration. Thus, the load could start and stop giving jerky motion. By introducing a feedback piston, the load pressure now reduces the opening of the meter-in spool and thus reducing the flow to the load during periods of high acceleration and with reduced load pressure condition there would be less feedback pressure and thus larger opening of the meter-in spool whereby more flow is introduced during period of low acceleration thus maintaining a more stable acceleration.

What is claimed is:

1. A hydraulic control system comprising a hydraulic actuator having opposed openings adapted to alternately function as inlets and outlets for moving the element of the actuator in opposite directions, a load sensing variable displacement pump for supplying fluid to said actuator, meter-in valve means to which the fluid from the pump is supplied, a pair of lines extending from said meter-in valve means to said respective openings of said actuator, said meter-in valve means being pilot controlled by alternately supplying fluid at pilot pressure to said meter-in valve means for selectively controlling the flow of fluid to the lines and thereby direction of movement of the actuator, meter-out valve means separate from and operable independently of said meter-in valve means associated with each opening of the actuator for controlling the flow out of said actuator, said meter-out valve means being pilot operated by the pilot pressure, and means for sensing the outlet pressure being directed to the actuator when the meter-in valve means is operated and providing a pressure proportional to outlet pressure on said meter-in valve means opposing the force of pilot pressure tending to actuate the meter-in valve means.

2. In a hydraulic control system comprising a hydraulic actuator having opposed openings adapted to alternately function as inlets and outlets for moving the element of the actuator in opposite directions, a load sensing variable displacement pump for supplying fluid to said actuator, pilot operated meter-in valve means to which the fluid from the pump is supplied for controlling the direction of movement of the actuator, separate pilot operated meter-out valve means operable independently of said meter-in valve means and associated with each opening of the actuator for controlling the flow out of said actuator, the method of controlling the operation of the pilot operated meter-in valve means which comprises sensing the outlet pressure being supplied to one opening of the actuator and applying a pressure proportional to outlet pressure to said meter-in valve means independently of said meter-out valve means opposing the movement of the meter-in valve means by pilot pressure in the direction for supplying fluid to the actuator.

3. A hydraulic control system comprising a hydraulic actuator having opposed openings adapted to alternately function as inlets and outlets for moving the element of the actuator in opposite directions, a load sensing variable displacement pump for supplying fluid to said actuator, meter-in valve means to which the fluid from the pump is supplied, a pair of lines extending from said meter-in valve means to said respective openings of said actuator, said meter-in valve means being pilot controlled by alternately supplying fluid at pilot pressure to said meter-in valve means for selectively controlling the flow of fluid to the lines and thereby direction of movement of the actuator, meter-out valve means separate from and operable independently of said meter-in valve means associated with each opening of the actuator for controlling the flow out of said actuator, said meter-out valve means being pilot operated by the pilot pressure, and means for sensing the outlet pressure being directed to the actuator when the meter-in valve means is operated and providing a pressure proportional to outlet pressure on said meter-in valve means opposing the force of pilot pressure tending to actuate the meter-in valve means, said meter-in valve means comprising a spool adapted to be actuated by pilot pressure, said spool having a supply pressure area and a piston area, a load sensing bleed orifice from the supply pressure area to the piston area of said spool, a separate piston within said spool, said separate piston having a piston area, and passage means in said spool extending from the supply pressure area of said spool to the piston area of said separate piston for providing a pressure proportional to outlet pressure on said meter-in valve means opposing the force of pilot pressure tending to actuate the meter-in valve means.

4. The hydraulic system set forth in claim 3 wherein a valve is provided in each line extending to said respective openings of said actuator to prevent return flow.

5. A hydraulic control system comprising a hydraulic actuator having opposed openings adapted to alternately function as inlets and outlets for moving the element of the actuator in opposite directions, a load sensing variable displacement pump for supplying fluid to said actuator, meter-in valve means to which the fluid from the pump is supplied, a pair of lines extending from said meter-in valve means to said respective openings of said actuator, said meter-in valve means being pilot controlled by alternately supplying fluid at pilot pressure to said meter-in valve means for selectively controlling the flow of fluid to the lines and thereby direction of movement of the actuator, meter-out valve means separate from and operable independently of said meter-in valve means associated with each opening of the actuator for controlling the flow out of said actuator, said meter-out valve means being pilot operated by the pilot pressure, and means for sensing the outlet pressure being directed to the actuator when the meter-in valve means is operated and providing a pressure proportional to outlet pressure on said meter-in valve means opposing the force of pilot pressure tending to actuate the meter-in valve means, a valve provided in each line extending to said respective openings of said actuator to prevent return flow.

* * * * *